United States Patent [19]

Zoltner

[11] Patent Number: 4,830,356

[45] Date of Patent: May 16, 1989

[54] PASSIVE "PINWHEEL" COPY SHEET ROTATOR

[75] Inventor: John D. Zoltner, Rochester, N.Y.

[73] Assignee: Xerox Corporation, Stamford, Conn.

[21] Appl. No.: 80,941

[22] Filed: Aug. 3, 1987

[51] Int. Cl.[4] ..... B65H 9/00

[52] U.S. Cl. ..... 271/226; 271/184; 271/225

[58] Field of Search ..... 271/225, 248, 250, 251, 271/184, 185, 113, 187, 226

[56] References Cited

U.S. PATENT DOCUMENTS

| | | | |
|---|---|---|---|
| 2,243,557 | 5/1941 | Finster | 271/52 |
| 3,779,546 | 12/1973 | Wojtowicz et al. | 271/196 |
| 3,809,214 | 5/1974 | Reist | 198/235 |
| 3,904,192 | 9/1975 | Pfeifer | 271/187 X |
| 3,907,276 | 9/1975 | Gerbasi | 271/184 X |
| 3,970,299 | 7/1976 | Berger | 271/250 |
| 4,462,736 | 7/1984 | Jenkins | 271/113 X |
| 4,541,626 | 9/1985 | Millen | 271/113 X |
| 4,546,964 | 10/1985 | Linthout | 271/251 X |
| 4,591,046 | 5/1986 | Toste, Jr. et al. | 198/457 |

FOREIGN PATENT DOCUMENTS

| | | | |
|---|---|---|---|
| 223650 | 12/1984 | Japan | 271/185 |
| 2028773 | 3/1980 | United Kingdom | 271/184 |

*Primary Examiner*—Richard A. Schacher
*Attorney, Agent, or Firm*—William A. Henry, II

[57] ABSTRACT

An in-line passive "pinwheel" copy sheet rotator in a rotating disc configuration for use in a copier, intermediate module or the like rotates copy sheets 90 or 180 degrees as desired. The disc has four quadrants and is used in combination with and positioned in-line with a sheet transport such as a ball-on-belt registration mechanism and an edge guide for registering the sheets once they have been rotated. Copy sheets come into contact with fins on the disc due to their movement by the ball-on-roll transport and are rotated along with the disc. A deflector is positioned over a portion of the disc in order to enhance the guiding of copy sheets into the disc by reducing the inertia of the disc after each copy is rotated and indexes each quadrant through the application of drag on the fins.

31 Claims, 4 Drawing Sheets

PASSIVE "PINWHEEL" COPY SHEET ROTATOR

The present invention relates to a device for handling lightweight sheets in transit, and more particularly to a simple and inexpensive device that rotates sheets at least 90 degrees within their plane of travel.

With the advent of high speed xerographic copy reproduction machines wherein copies can be produced at a rate in excess of three thousand copies per hour, the need for devices that will reorient the copy sheets is apparent. That is, various finishing systems require the reorientation of copy sheets after they exit a copier or printer before certain functions can be performed on them. For example, in order to perform standard letter folds using a buckle folder, the copy sheets must be fed to the folder short edge first. Since the output from most copiers and electronic printers is long edge first, some type of sheet turning mechanism is necessary if folding is to be done in an on-line, straight-line system.

Various sheet turners are available, for example, U.S. Pat. No. 2,243,557 discloses a sheet turning apparatus in which a sheet is transported to a rotating apparatus by a series of tapes. The lower edge of the sheet is engaged by a ball member and the forward motion of the sheet is stopped at that point. Subsequently, the upper portion of the sheet pivots around the retained sheet corner by the cooperative means of gravity and a flipper fin. Thus, the sheet completes a 90 degree rotation when its edge contacts a registration guide. Finally, the sheet is propelled forward to another set of tapes for additional transport in its new orientation. In U.S. Pat. No. 3,779,546 a rotating wheel assembly is shown employed for transporting documents through various changes in orientation. A wheel assembly is provided with a pair of vacuum platens mounted thereon. A document is introduced to, and secured at, a platen. The wheel and platen assembly then rotate in a fashion to execute a desired direction change in the movement of the document. A turning conveyor for flat articles is shown in U.S. Pat. No. 3,809,214 that is used for changing the orientation of an overlying spread stack formation of documents. A plurality of entrainment members revolve on an endless transport chain structure. Documents are engaged by the entrainment and rotated through a 90 degree turn in document orientation as they are transported by the conveyor. A turntable transfer apparatus for a conveyor system is disclosed in U.S. Pat. No. 4,591,046. The axis of the turntable device is on a line that bisects the angle between two conveyor elements. The turntable possesses gripper arms which are utilized to latch onto articles. The turntable grasps an article from one conveyor element and transports it to the second conveyor element. These patents are incorporated herein by reference. The problem with these devices is that they are bulky, costly, cumbersome, unwieldly and impractical for use in present day small and compact copiers, intermediate modules and finishers.

Accordingly, disclosed in accordance with the present invention is a compact, lightweight, plastic "pinwheel" rotator that is positioned inline with a ball-on-belt or crossed roll registration edge. As copies feed into the pinwheel, the lead edge of each copy sheet pushes against one of four fins of the rotator and rotates it 90 degrees. This action trips each copy sheet and also causes eacy copy sheet to rotate 90 degrees.

For a better understanding of the invention, reference is made to the following drawings and description.

The invention will now be described by reference to a preferred embodiment of the copy sheet rotator apparatus.

Figure 1:
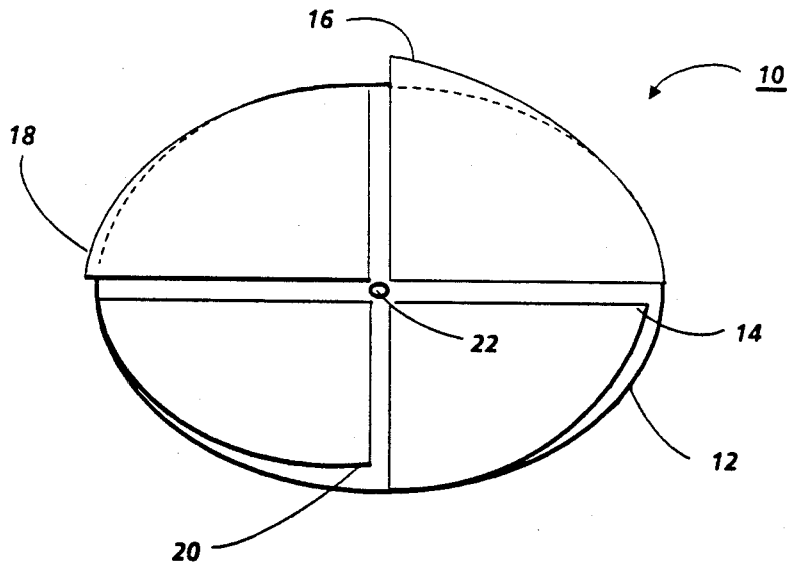
FIG. 1 is an isometric view of an exemplary sheet rotator in accordance with the present invention.

Referring now particularly to FIG. 1, there is illustrated an exemplary copy sheet rotator 10 in accordance with the present invention. The copy sheet rotator is configured as a lightweight approximately 4.55 inch diameter pinwheel or disc 12 of about 0.008 inch thick mylar. Four vanes or fins 14, 16, 18 and 20 are either molded with disc 12 as a single member or attached in a conventional manner to disc 12 in four different quadrants of the disc 90 degrees apart. The fins are also 0.008 inch in thickness and extend upward from the upper surface of disc 12 into the path of incoming copy sheets. A pivot point 22 is positioned in the center of the disc so that the disc can be rotated. The fins that comprise the four quadrants of the disc (denoted as 1, 2, 3 & 4 in FIGS. 2 and 3) are offset from the pivot point 22 such that the pivot shaft that controls the disc during rotation will not damage copy sheets they cannot collide against it. Also, the pivot point is fixed outside of the sheet registration edge guide 25. A deflector plate 27 which could be transparent plexiglass is placed over two quadrants of the disc. This serves two functions; (1) the pinwheel fins are collapsed as the assembly rotates to better guide copy sheets into the rotator, and (2) drag is applied to the pinwheel so that it only rotates 90 degrees per copy. An appendage 27A is included as part of the deflector plate and is adapted such that it closes the incoming fin which aids in stopping the disc in order to ready it for the next copy. In order to regulate the amount of drag applied to the fins of the deflector, adjustable screw 27B is used to load a member 27 against the fins of the deflector.

Figure 2:
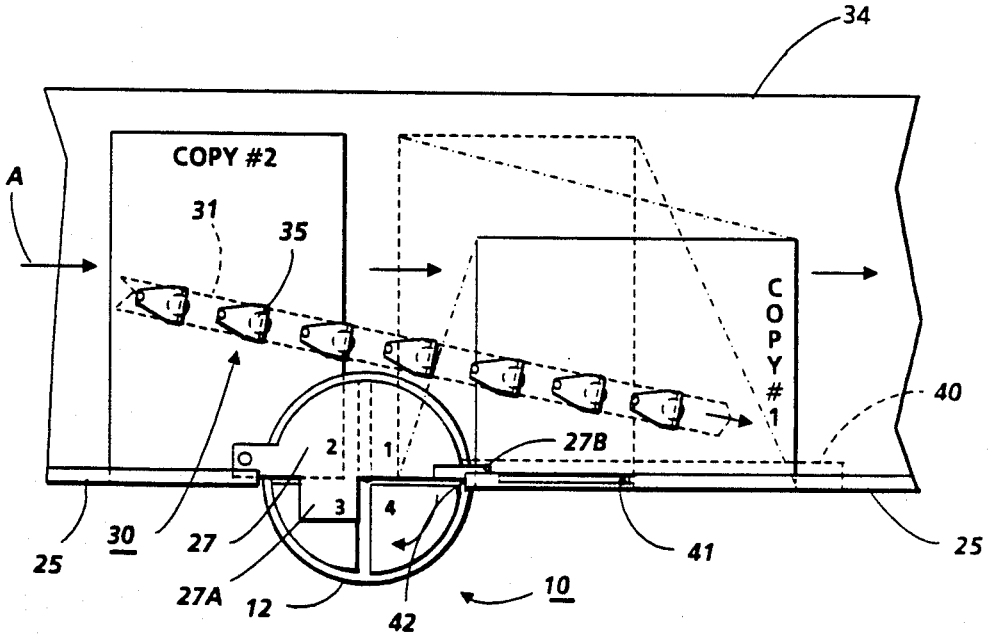
FIG. 2 is a plan view of the sheet rotator of FIG. 1 showing sheet #1 having been rotated.
Figure 3:
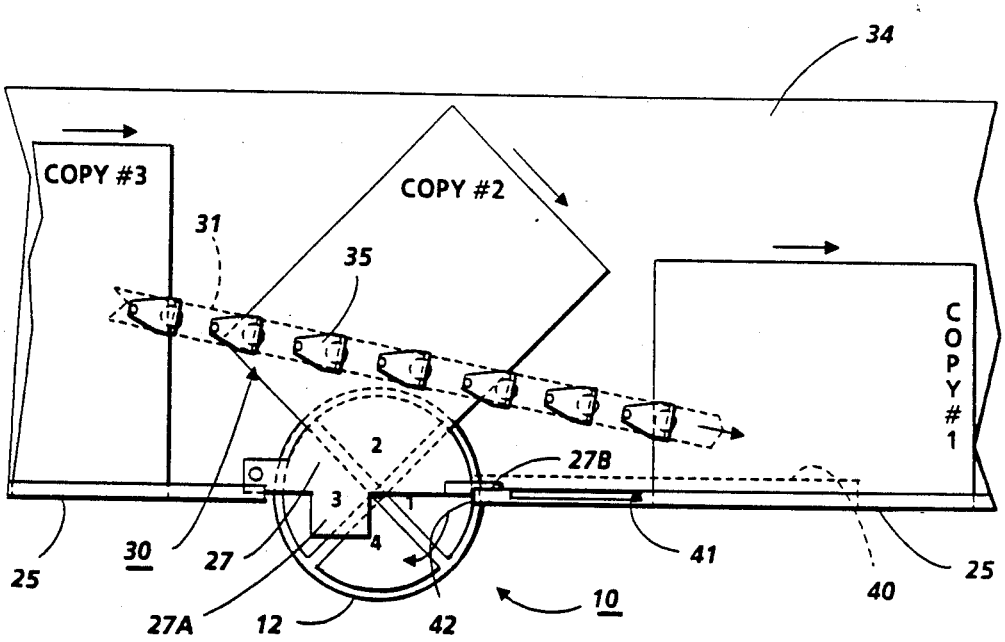
FIG. 3 is a plan view of the sheet rotator of FIG. 2 showing sheet #2 being rotated by the sheet rotator of FIG. 1.
Figure 8:
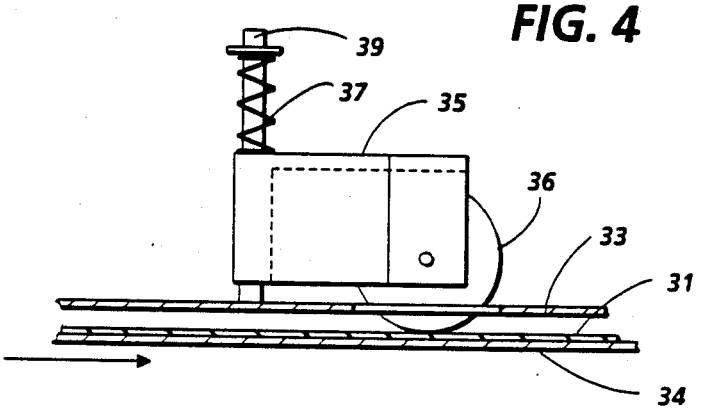
FIGS. 8 and 9 show a ball on belt retainer assembly.
Figure 9:
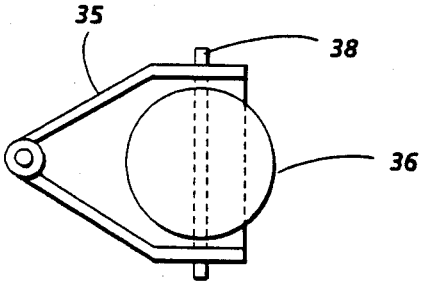

As shown in a horizontal configuration in, FIGS. 2 and 3, freewheeling copy sheet rotator 10 is positioned between registration edge guide 25 and another edge guide not shown. A ball-on-belt transport 30 that includes a belt 31 and a superposed cooperating member 33 of FIG. 8 having a retainer assembly 35 mounted thereon by post 39 and balls 36 loosely positioned on a shaft within the retainer assembly with the retainer assembly being adapted to drive copy sheets to the right as viewed in FIGS. 2 and 3. Balls 36 could be plastic rollers instead of plastic balls. Retainer assembly 35 is shown in FIGS. 8 and 9 as being moveably or resiliently biased by compression spring 37 toward belt 31 that runs between cover plate 33 and bottom plate 34. Member 31 is angled toward registration edge 25 in order to drive sheets against the registration edge. As ball-on-belt transport 30 drives consecutively spaced copies (in "portrait" orientation) in the direction of arrow A against registration edge guide 25, each right hand leading edge corner of a copy sheet enters separate quadrants of the copy sheet rotator. This action (controlling the copy's corner while the ball-on-belt transport continues to drive the copy sheet) causes the copy sheet to be rotated 90 degrees about its lower right hand corner axis, so that the copy's "portrait" orientation is changed to a "landscape" orientation. More particularly, FIG. 2 shows copy #1 (rotated)) leaving quadrant 1 of copy rotator 10 while FIG. 3 shows copy #2 in the act of being rotated by quadrant 2 of the copy sheet rotator. It should be apparent that copy sheet rotator 10 is small, very inexpensive and rotates copies of any size or orientation. The rotator is independent of intercopy gap spacing (since each copy pivots at the extreme right hand corner, the trail edge always rotates out of the path of the next consecutive copy). Copy sheet rotator 10 also maintains the same edge registration plane before and after rotation and rotates 16#, 20# and 110# copy sheets with equal efficiency.

Figure 5:
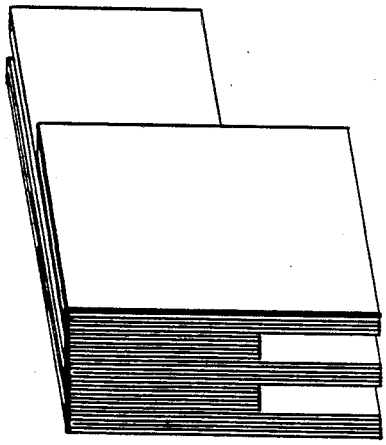
FIG. 5 is an isometric view of cross-stacked copy sheet sets accomplished with the copy sheet rotator of FIG. 1 where every other set has been rotated 90 degrees.
Figure 4:
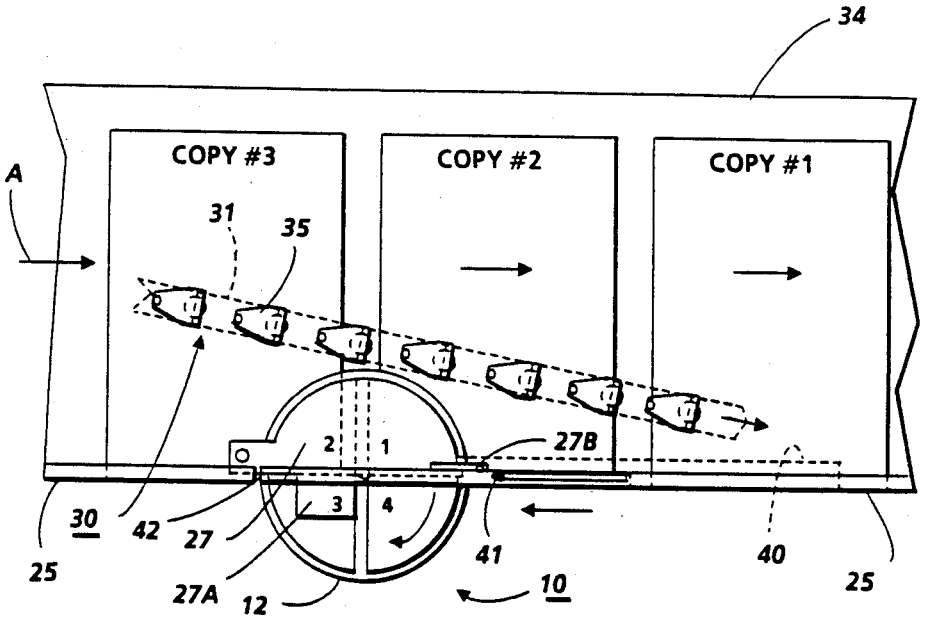
FIG. 4 is a plan view of the sheet rotator of FIG. 3 showing an actuated registration edge by-pass slide assembly.

The passive copy sheet rotator 10 can be used to cross-stack copy sheet sets as shown in FIG. 4 in lieu of costly offset stacking apparatuses by simply rotating every other set of copies, i.e., a conventional copier such as U.S. Pat. No. 4,346,880 which is incorporated herein by reference could be programmed such that one could punch a control button on the console of the copier that would inactivate copy sheet rotator 10 while a first set of copies are being stacked and actuate the copy sheet rotator when a second set of copy sheets is initiated. This method would be repeated depending on the number of sets of a particular document desired. An inexpensive way of orienting duplex copies 180 degrees with the copy sheet rotator of the present invention as shown in FIG. 5 is to pass the copies through two rotators in-line.

In FIGS. 2, 3 and 4, a registration edge by-pass slide assembly 40 is included that is mounted in cover plate 33 and adjacent registration edge 25. By-pass slide assembly 40 has a stud or handle 41 that is shown in a passive position in FIGS. 2, and 3, i.e., it has no effect on the passage of copy sheets as they pass through the area of copy sheet rotator 10. However, when the stud 41 is pushed to the left as viewed in FIG. 4 either manually or actuated by a solenoid through a button on the console of a machine, a small, nested registration edge slide segment 42 connected to the stud is moved to the left and bridges across the rotator disc 10 and allows copies to pass straight through the area of the rotator without any rotation. Idler rollers are enabled by the use of solenoids to provide drive through the area that the copy sheets are usually rotated. This slide assembly could be used at any location where a rotation disc is employed. One means of remote engagement/disengagement of by-pass 40 in a vertical orientation would be to use a flexible cable to actuate the nested registration edge slide. A flexible cable would be mounted to the frame under covers on the interface module with a manually operable, console mounted slide knob transmitting motion to the vertical registaration edge nested slide. Knob position on the console would also serve as a status indicator for copy presentation mode.

Figure 6:
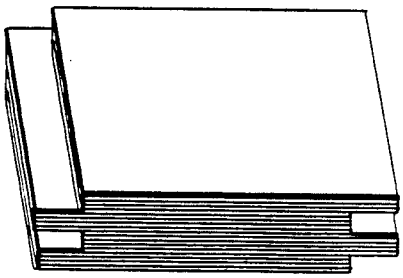
FIG. 6 is an isometric view of an offset stack of copy sheet sets accomplished with conventional stackers.
Figure 7:
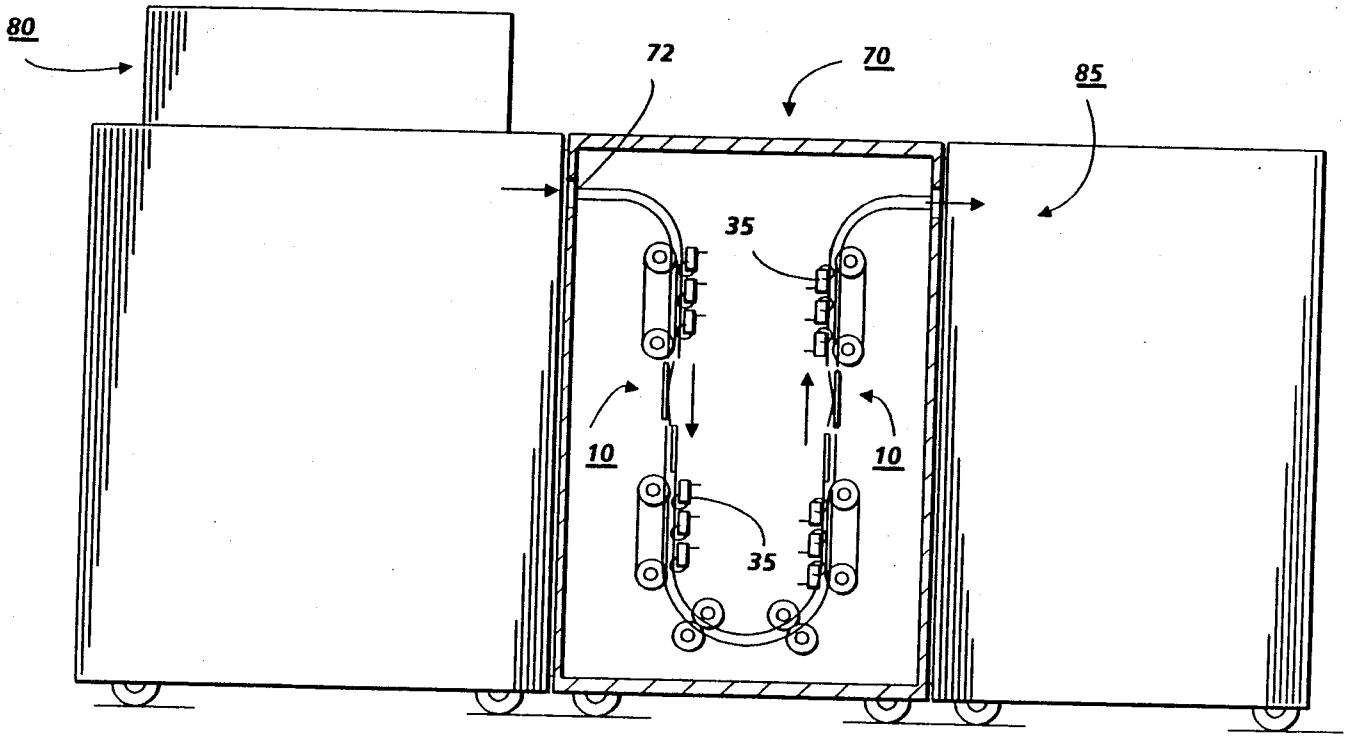
FIG. 7 is a front view of an intermediate module for rotating sheets that is inserted between a copier and a finisher that employs copy sheet rotators in accordance with an aspect of the present invention.

FIG. 7 shows an intermediate module 70 in accordance with an aspect of the present invention that is positioned between a conventional copier, printer or copier/printer combination and a finisher that is used to reorient copy sheets before they reach the finisher. As seen in FIG. 6, copies leaving the copier 80 enter intermediate module 70 at 72 and during their transport toward the finisher 85 come in contact with copy sheet rotator 10 and are rotated 90° as described and shown in FIGS. 2 and 3. After they are rotated, the copy sheets continue in route to the finisher for stacking, stapling, bookmaking, folding or some other type of finishing processing. In a copier with a document handler that exits copies in N→1 sequence, copies are placed into a compiler tray with N on the bottom and 1 on top and a stitch/staple is placed in the correct corner, from the top of the stack. when a printer with electronic imaging is used to make copies, they exit in the 1→N sequence and the copies are typically compiled face down with their images rotated 180° from the N→1 copier type devices. In accordance with one aspect of the present invention, two copy sheet rotators in series could be used to orient all sheets exiting either a printer or a copier in the same direction. This would solve the problem of having to move a stitcher/stapler head in a common (N→1 & 1→N) compiler tray from a lead edge front corner to a trail rear corner or a trail edge front corner to a lead edge rear corner. This does not solve the problem of the staple being up-side-down in one of the configurations, but if the compiling is always in the same direction, one could manually or automatically flip the stitcher/stapler head up-side-down to maintain correct staple orientation. Two copy sheet rotators could be be used to reorient sheets by 180° that are leaving a machine in order to position markings in their margins so that a sensing station will be able to sense them.

Intermediate module 70 as shown does not include a horizontal transport that could be used to transport sheets straight through the copier to the finisher when rotation rotation is not required. However, it is preferred that the horizontal transport not be used and a copy sheet rotator disenabler 40 be used to deactivate copy sheet rotators 10 and/or 11 when either 90° or 180° copy sheet reorientation is not required.

It should now be apparent that a clever, inexpensive copy sheet rotator is disclosed that enables a multitude of finishing options. The device includes a thin Mylar disc that has a plurality of fins adapted to extend upward from the surface of the disc and intercept copy sheets as they are fed by a transport system. Mylar is a trademark of E. I. du Pont de Nemours & Co. for a polyester film. As the copy sheets continue to feed, they drive the rotator and is itself rotated 90 degrees to a registration edge. The rotator acts like a revolving door and changes orientation and not direction of transport.

While the invention has been particularly shown and described with reference to preferred embodiments thereof, it will be understood by those skilled in the art that various changes in form and details may be made therein without departing from the spirit and scope of the invention.

What is claimed is:

1. A copy sheet rotator adapted to change the direction of sheets in transit for further processing, comprising: sheet transport means within a predetermined plane for moving sheets in a particular direction, and disc means positioned in-line with said sheet transport means, said disc means being adapted for rotation and having a planar surface that extends in the plane of said sheet transport means and a series of protrudable fins for protruding outward from said planar surface, said fins being adapted to intercept sheets transported by said sheet transport means and rotate said disc means due to the momentum of the sheets and thereby change direction of the sheets.

2. The copy sheet rotator of claim 1, including edge registration means for registering sheets before they are rotated.

3. The copy sheet rotator of claim 1, including edge registration means for registering sheet before and after rotation.

4. The copy sheet rotator of claim 3, wherein said disc means is adapted to rotate the sheets in an arc of 90 degrees.

5. The copy sheet rotator of claim 3, wherein said disc means is adapted to rotate the sheets in an arc of 180 degrees.

6. The copy sheet rotator of claim 1, wherein said sheet transport means comprises a ball-on-belt device.

7. The copy sheet rotator of claim 6, wherein said ball-on-belt device includes ball members supported in a retainer assembly superposed and obliquely positioned with respect to the plane of a belt member so as to assist in driving sheets into said registration edge.

8. The copy sheet rotator of claim 1, including a multi-mode registration edge by-pass assembly adapted when in a first mode to allow copy sheets to be acted upon by said copy sheet rotator and when in a second mode to deactivate said copy sheet rotator such that copy sheets pass over said copy sheet rotator without being rotated.

9. The copy sheet rotator of claim 1, including deflector means positioned over a portion of said rotator means in order to enhance the guiding of sheets into said rotator means.

10. A device for rotating sheets either 90 or 180 degrees while they are in transit on a sheet transport means within a predetermined plane, comprising: a passive rotatable disc having a planar surface positioned within said predetermined plane, said disc including a plurality of raised portions on said planar surface thereof that are adapted to intercept the sheets individually and rotate with the sheets due to the momentum of the sheets in transit.

11. The copy sheet rotator of claim 10, including edge registration means for registering sheets before they are rotated.

12. The copy sheet rotator of claim 11, wherein said sheet transport means comprises a ball-on-belt device.

13. The copy sheet rotator of claim 12, wherein said ball-on-belt device includes ball members supported in retainer assembly superposed and obliquely positioned with respect to the plane of a belt member so as to assist in driving sheets into said registration edge.

14. The copy sheet rotator of claim 10, including edge registration means for registering sheets before and after rotation.

15. The device for rotating sheets of claim 10, including deflector means positioned over a portion of said rotator means in order to enhance the guiding of sheets into said rotator means.

16. A copy sheet rotator, comprising: a sheet transport which transports copy sheets in a given plane, and a rotator means having at least one vane extending from a surface positioned within said given plane and in the direction of feed of the copy sheets thereof and adapted such that a copy sheet being transported by said sheet transport contacts said at least one vane and drives the rotator means and is itself rotated therewith.

17. The copy sheet rotator of claim 16, including a registration edge and wherein the sheets are rotated to said registration edge.

18. The copy sheet rotator of claim 16, wherein said rotator means includes four vanes.

19. The copy sheet rotator of claim 16, including a deflector member that is adapted to enhance the ability of said at least one vane in capturing said sheet.

20. The copy sheet rotator of claim 16, including edge registration means for registering said sheet before and after rotation.

21. The copy sheet rotator of claim 16, including a multi-mode registration edge by-pass assembly adapted when in a first mode to allow copy sheets to be acted upon by said copy sheet rotator and when in a second mode to deactivate said copy sheet rotator such that copy sheets pass over said copy sheet rotator without being rotated.

22. The copy sheet rotator of claim 16, wherein said rotator means is made of plastic.

23. The copy sheet rotator of claim 16, wherein said rotator means is made of Mylar.

24. A copy sheet rotator adapted to change the direction of sheets in transit for further processing, comprising: sheet transport means for moving sheets in a particular direction within a predetermined plane and disc means positioned in-line with said sheet transport means, said disc means being adapted for rotation and having a planar surface within said predetermined plane and a series of protrudable fins for protruding outward from said planar surface, said fins being adapted to intercept sheets transported by said sheet transport means and rotate said disc means due to the momentum of the sheets and thereby change direction of the sheets, and deflector means positioned over a portion of said disc means in order to enhance the guiding of sheets into said disc.

25. The copy sheet rotator of claim 24, wherein said disc means includes a pair of discs positioned in series in order to manipulate duplexed copy sheets.

26. The copy sheet rotator of claim 24, including a multi-mode registration edge by-pass assembly adapted when in a first mode to allow copy sheets to be acted upon by said coy sheet rotator and when in a second mode to deactivate said copy sheet rotator such that copy sheets pass over said copy sheet rotator without being rotated.

27. A device for rotating sheets while they are in transit on a sheet transport means within a predetermined plane, comprising: a passive rotatable disc positioned within said predetermined plane, said disc including a plurality of raised portions on a surface thereof within said predetermined plane that are adapted to intercept the sheets individually and rotate with the sheets due to the momentum of the sheets in transit and deflector means positioned over a portion of said passive rotatable disc in order to enhance the guiding of sheets into said disc.

28. The copy sheet rotator of claim 27, wherein said passive rotatable disc is adapted to be rotated or not rotated depending on whether copy sheet sets are to be cross-stacked.

29. The device for rotating sheets of claim 27, including a multi-mode registration edge by-pass assembly adapted when in a first mode to allow copy sheets to be acted upon by said copy sheet rotator and when in a second mode to deactivate said copy sheet rotator such that copy sheets pass over said copy sheet rotator without being rotated.

30. A copy sheet rotator, comprising: a sheet transport positioned within a predetermined plane and a rotator means having a planar surface positioned in said predetermined plane of said sheet transport and at least one vane extending from a surface thereof and adapted such that a sheet being transported by said sheet transport contacts said at least one vane and drives the rotator means and is itself rotated therewith and deflector means positioned over a portion of said rotator means in order to enhance the guiding of sheets into said rotator means.

31. The copy sheet rotator of claim 30, including a multi-mode registration edge by-pass assembly adapted when in a first mode to allow copy sheets to be acted upon by said copy sheet rotator and when in a second mode to deactivate said copy sheet rotator such that copy sheets pass over said copy sheet rotator without being rotated.

* * * * *